US006449989B2

(12) United States Patent
Ternon

(10) Patent No.: US 6,449,989 B2
(45) **Date of Patent: *Sep. 17, 2002**

(54) HOOK AND LOOP FASTENING STRUCTURE

(75) Inventor: Gerard Lucien Roger Ternon, Bolbec (FR)

(73) Assignee: Milliken & Company, Spartanburg, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,899

(22) Filed: Apr. 16, 1999

(51) Int. Cl.[7] ..... D04B 21/02
(52) U.S. Cl. ..... 66/195; 66/193
(58) Field of Search ..... 428/99, 100, 85; 442/312; 66/190, 191, 192, 194, 195

(56) References Cited

U.S. PATENT DOCUMENTS

| | | | | | |
|---|---|---|---|---|---|
| 3,769,815 | A | * | 11/1973 | Ploch et al. | 66/191 |
| 4,609,581 | A | * | 9/1986 | Ott | 428/100 |
| 4,705,710 | A | | 11/1987 | Matsuda | 428/92 |
| 4,739,635 | A | * | 4/1988 | Conley et al. | 66/190 |
| 4,770,917 | A | * | 9/1988 | Tochacek et al. | 428/95 |
| 4,838,044 | A | | 6/1989 | Matsuda et al. | 66/190 |
| 4,931,343 | A | * | 6/1990 | Becker et al. | 428/95 |
| 5,119,643 | A | * | 6/1992 | Conley et al. | 66/190 |
| 5,373,712 | A | * | 12/1994 | Yamamoto et al. | 66/195 |
| 5,520,021 | A | | 5/1996 | Clerici | 66/193 |
| 5,664,441 | A | | 9/1997 | Clerici | 66/193 |

FOREIGN PATENT DOCUMENTS

| | | |
|---|---|---|
| CA | 2151220 | 1/1996 |

OTHER PUBLICATIONS

Joseph, Marjory L. Introductory Textile Science. Holt, Rhinhart and Winston, New York, 1986 p. 249.*

* cited by examiner

*Primary Examiner*—Danny Worrell
(74) *Attorney, Agent, or Firm*—Terry T. Moyer; Jeffery E. Bacon

(57) ABSTRACT

A female member of a hook and loop attachment structure enables a one to one correspondence between loops and stitches in the knitted structure. The female member comprises individual wales of chain stitches with loops, wherein the wales of chain stitches are knitted on a supporting background, such that there is a corresponding number of loops to stitches. Each stitch may be associated with a respective loop or each loop may be attached to two respective stitches. The loops may be formed using a single guide bar, and the wales of chain stitches with loops may be made either with a single yarn or with two yarns.

6 Claims, 12 Drawing Sheets

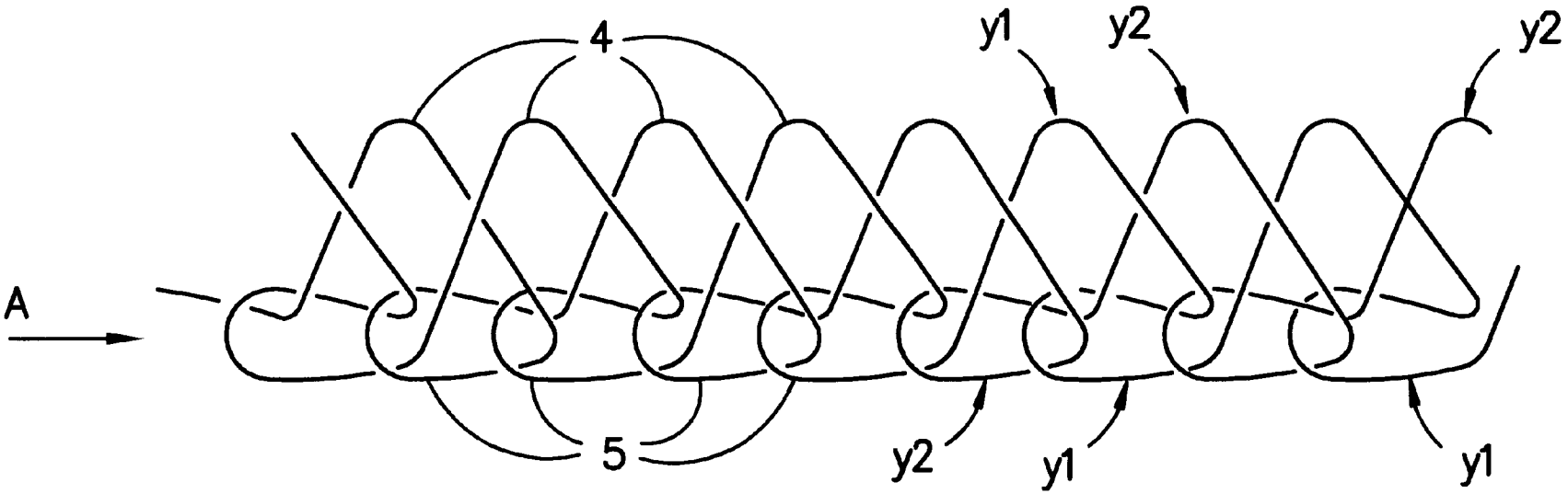
FIG. —3—

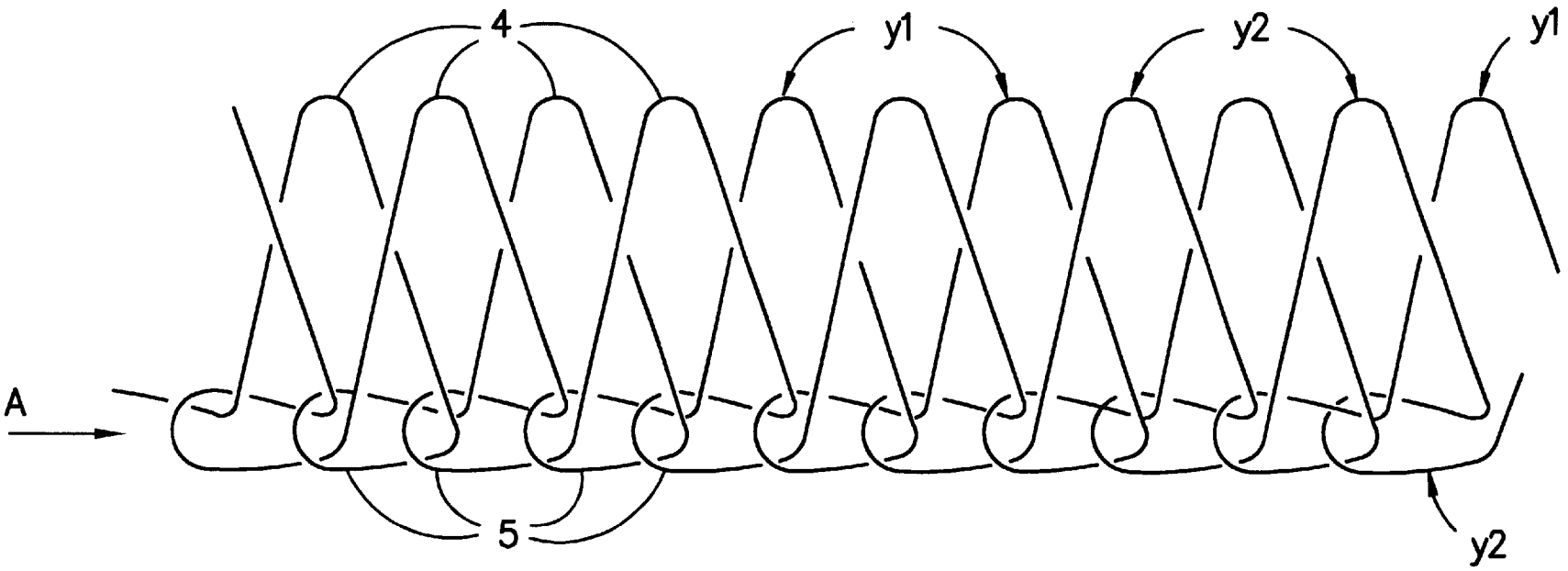
FIG. —3c—

HOOK AND LOOP FASTENING STRUCTURE

BACKGROUND

This invention relates to a hook and loop attachment or fastening structure.

Typically, such structures comprise both male and female components; the male component having a series of hooks, and the female component having a wale of corresponding loops, connectable to the hooks to enable fastening. The present invention is particularly concerned with the female component of the structure.

In our earlier U.S. Pat. No. 4,624,116 there is described a warp knit, weft inserted fabric which can be employed as the female component of a securing means. The disclosure in that document provides for open lap loops, formed by the front bar of a knitting machine, which projects upwardly from the fabric on every second stitch.

An object of the present invention is to provide a female member of a hook and loop attachment structure which enables a 1 to 1 correspondence between loops and stitches in the knit structure. Similarly, it is intended to show a female member wherein there is a loop formed at each stitch of the background fabric. A further object is to form the loops using only a single loop bar.

According to a first aspect of the present invention there is provided a female member of a hook and loop fastening or attachment structure comprising individual wales of chain stitches with loops, wherein the wales of chain stitches are knitting on a supporting background, characterized in that there is a corresponding number of loops to stitches.

Optionally, each stitch is associated with a respective loop. Alternatively, each loop may be attached to two respective stitches.

Optionally the background structure may be a regular warp knitted fabric. Alternatively, it may be a weft insertion warp knitted fabric.

A further alternative is that the support background may be of a non-woven material or a film material.

According to a second aspect of the present invention there is provided a method for producing a female component of an hook and lop fastening structure as described above wherein the loops are formed using a single guide bar.

The wales of chain stitches with loops may be made with a single yarn or with two yarns.

BRIEF DESCRIPTION OF THE DRAWINGS

In order to portray a better understanding of the intended invention, embodiments will now be described, by way of example only, with reference to the accompanying figures, in which.

Similarly

Similarly

DETAILED DESCRIPTION

Referring firstly to FIGS. 1 to 1*c* and 3 to 3*c*, chain stitches 2 on a wale 1 are each associated with respectively loops 3. The loops 3 are upstanding and provide a female connecting means to a male member comprising engageable hooks (non shown). The loops may be made from a specific yarn using a single guide bar.

Figure 1:
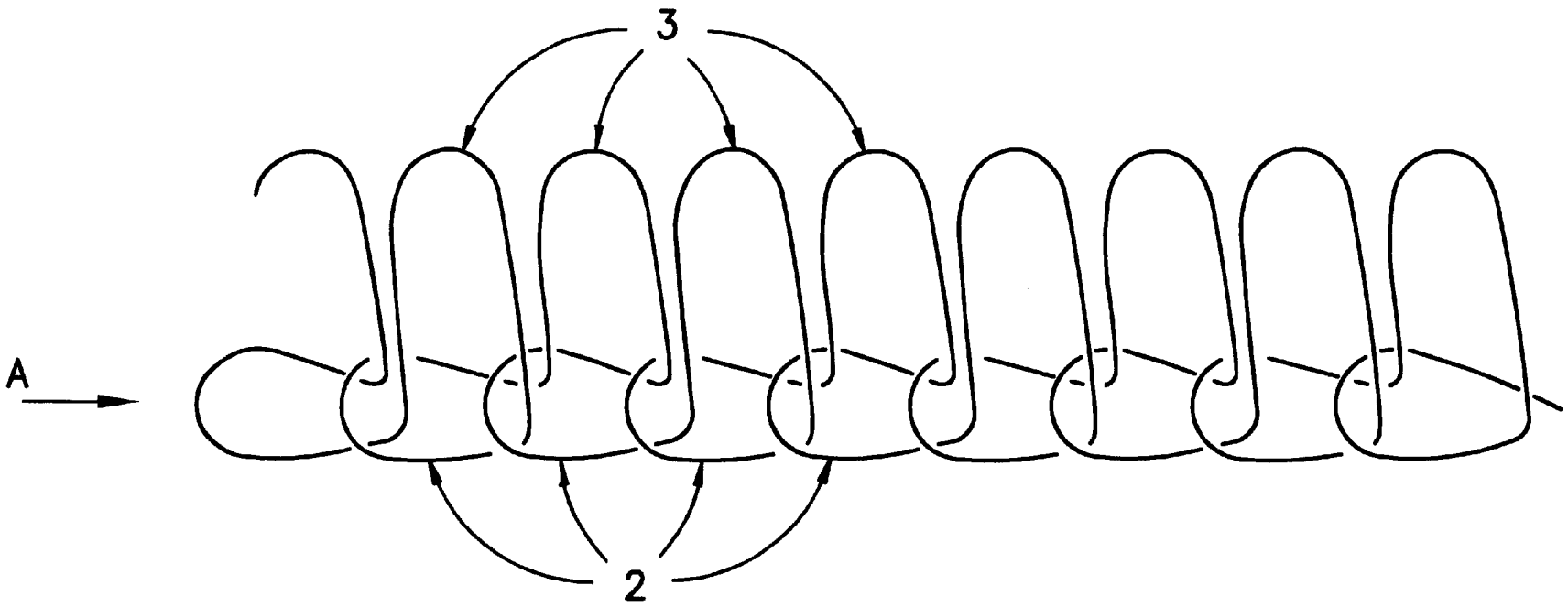
FIGS. 1 to 1*c* are schematic representations of a novel loop pile using a single yarn.
Figure 1A:
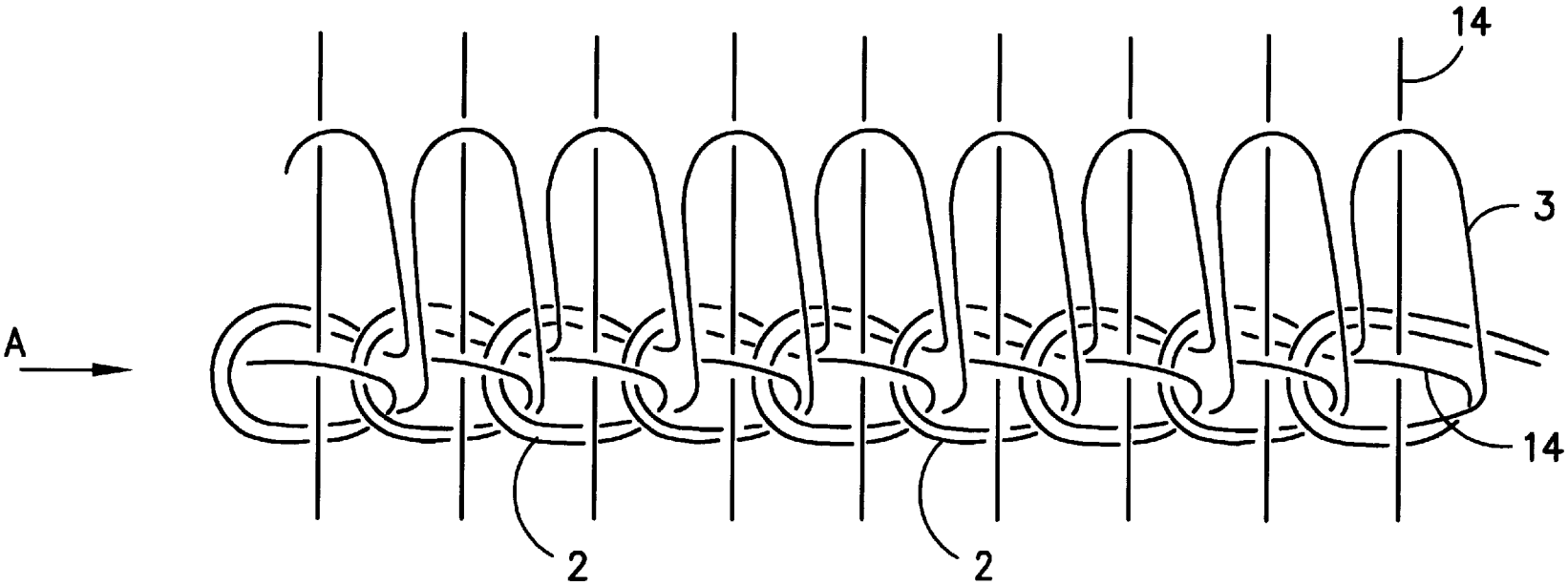
Figure 1B:
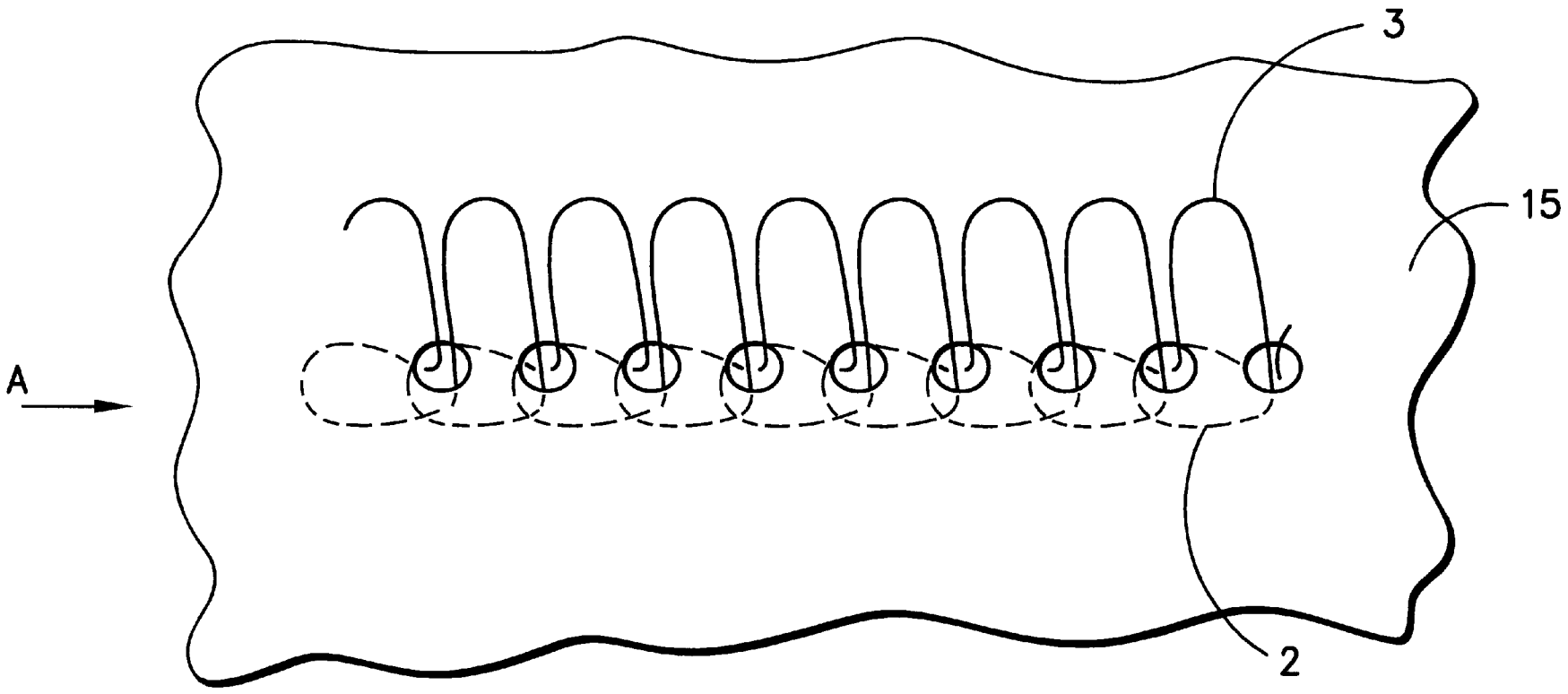
Figure 3A:
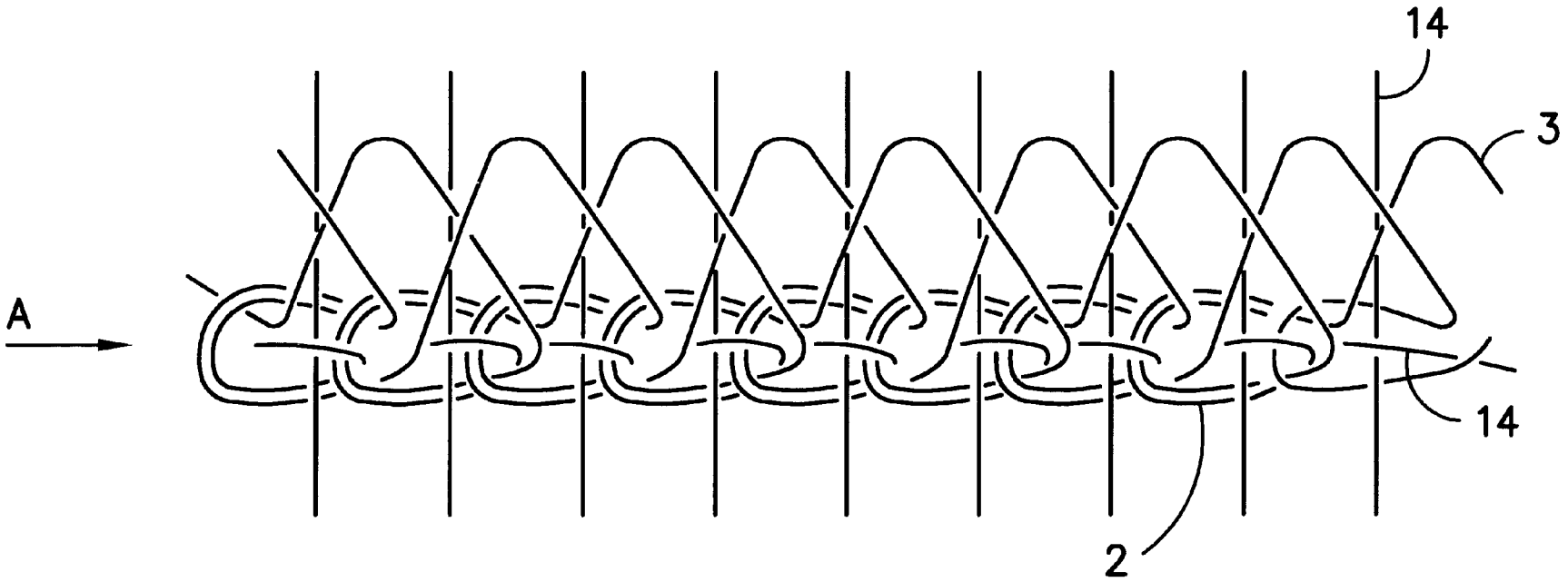
FIGS. 3 to 3*c* are schematic representation of a further novel loop pile using two yarns.
Figure 3B:
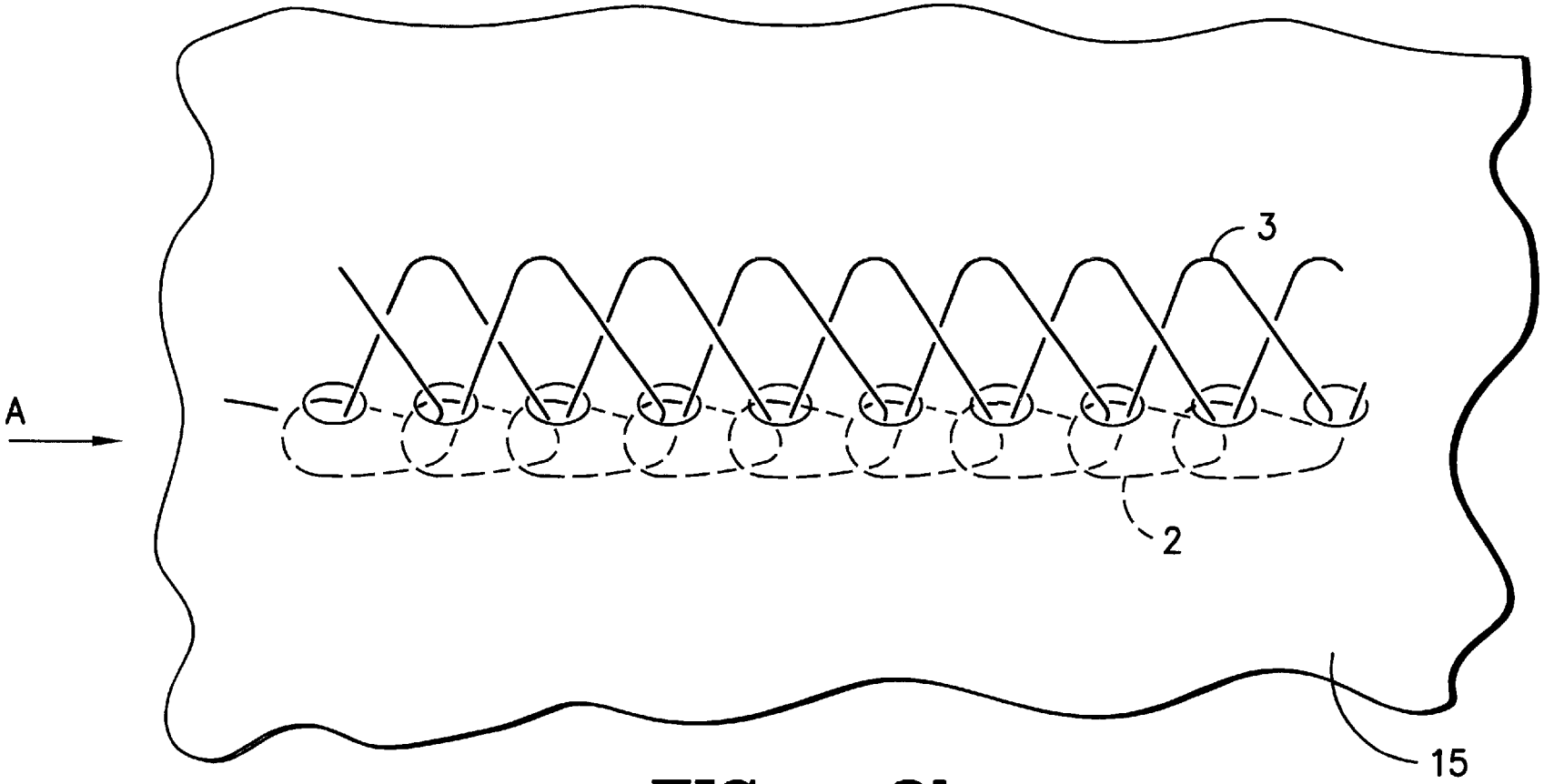

The wale, in use, would typically be supported on a background, which may be a knitted fabric as referenced 14 in FIGS. 1*a* and 3*a*, or a film or other non-woven material as referenced 15 in FIGS. 1*b* and 3*b*.

Where a firm or non-woven material was employed the wales would preferably be stitched through the background material.

Notably in FIG. 1 the loops 3 are made on the front side of the chain stitches 2.

The front side is opposed to the backside or technical side for a knitted fabric and in FIG. 3 the loops 4 are made on the front side of the chain stitches 5.

Figure 2A:
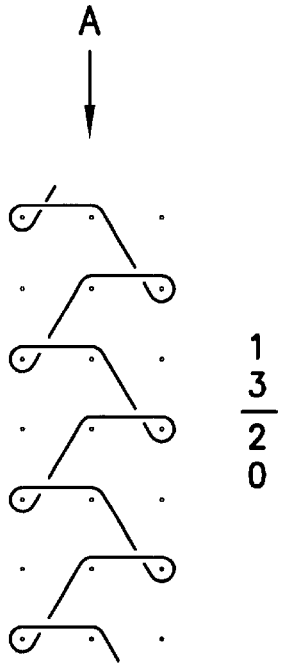
FIG. 2*a* is a point diagram of the action of the guide bar of a knitting machine to produce the embodiment of FIG. 1 with a closed stitch construction; the Arrow A indicated the needle making the chain stitches 2 FIG. 1.
Figure 2B:
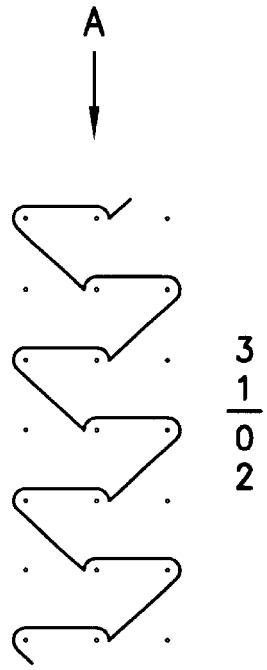
FIG 2*b* is a point diagram of the action of the guide bar of a knitting machine to produce the embodiment of FIG. 1 with an opened sitich construction; the Arrow A indicates the needle making the chain stitches 2 on FIG. 1.

Having regard to the embodiments of FIG. 1, FIGS. 2*a* and 2*b* demonstrate how either closed stitches or opened stitches may be used. In FIG. 2*a* the pattern wheel of the front bar of a knitting machine is set to knit a 1-3, 2-0 closed stitch. In FIG. 2*b* the pattern wheel of the front bar of a knitting machine is set to knit a 3-1, 0-2 opened stitch.

FIG. 3 illustrates an alternative embodiment wherein two yarns are employed Y1, Y2.

In the embodiment shown each loop 4 extends from two underlying chain stitches 5, there still being a corresponding number of loops 4 to stitches 5.

Figure 4A:
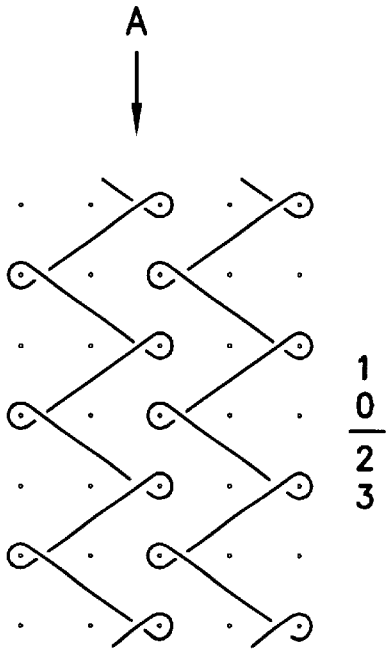
FIG. 4*a* is a point diagram of the action of the guide bar of a knitting machine to produce the embodiment of FIG. 3 with a closed stitch construction; the Arrow A indicates the needle making the chain stitches 5 on FIG. 3.
Figure 4B:
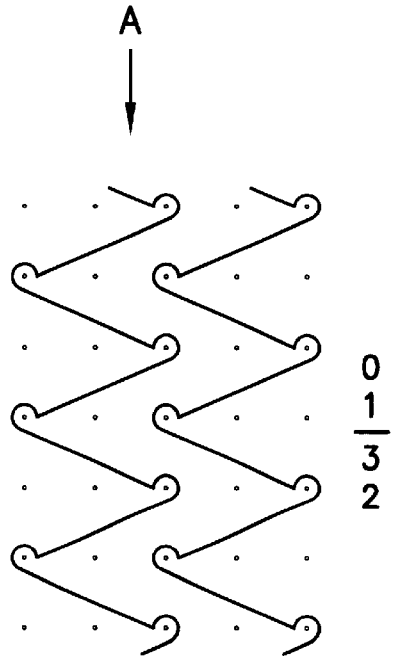
FIG. 4*b* is a point diagram of the action of the guide bar of a knitting machine to produce the embodiment of FIG. 3 with an opened stitched construction; the Arrow A indicated the needle making the chain stitches 5 on FIG. 3.

FIG. 4*a* shows a point diagram for the embodiment of FIG. 3 using a stitch notation of 1-0/2-3 to form a closed stitch. The stitch notation could alternatively be 0-1/3-2 forming an opened stitch structure as illustrated in FIG. 4*b*.

Figure 1C:
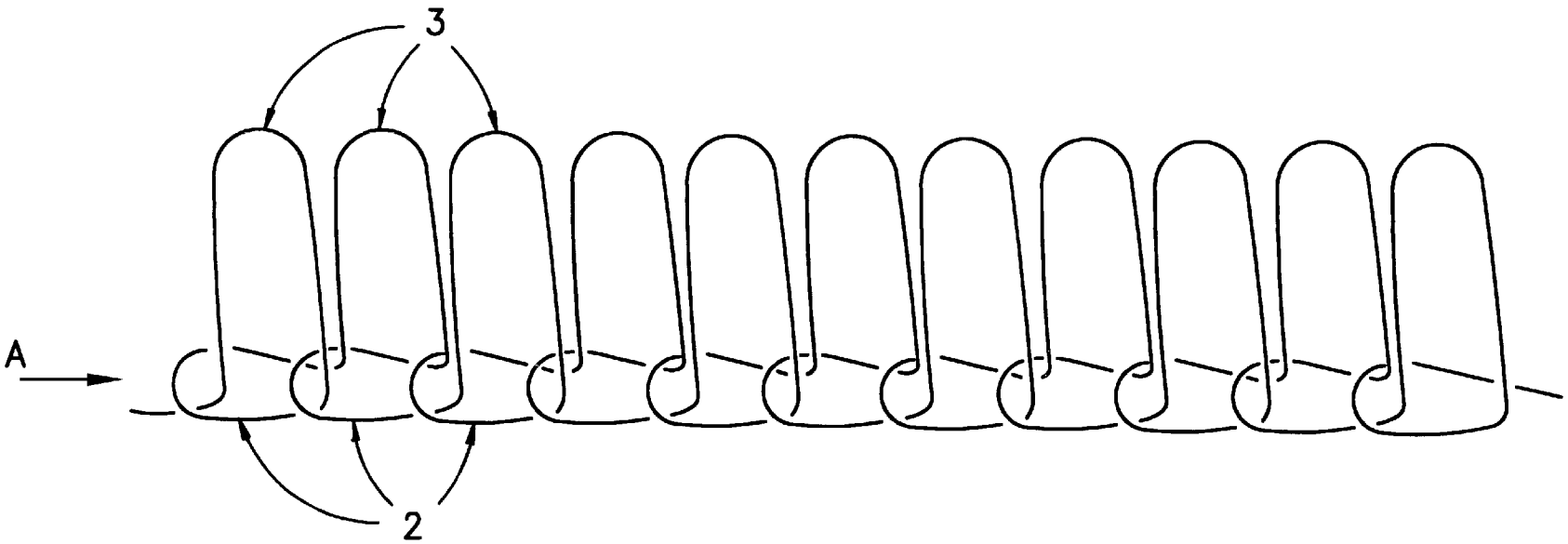
Figure 5A:
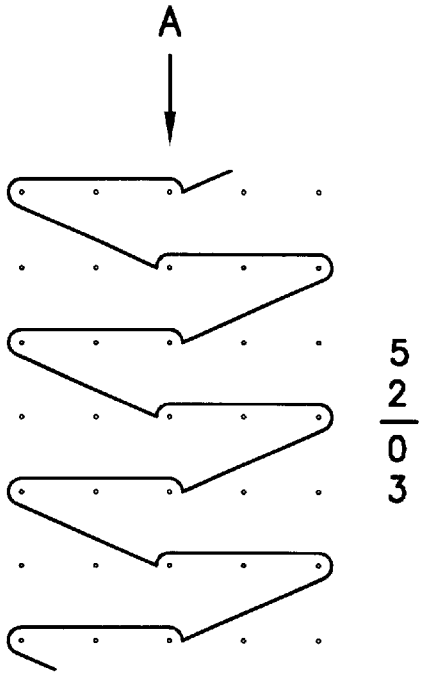
FIGS. 5*a* and 5*b* are point diagrams of the action of a guide bar of a knitting machine to produce the embodiment of FIG. 1*c;*
Figure 5B:
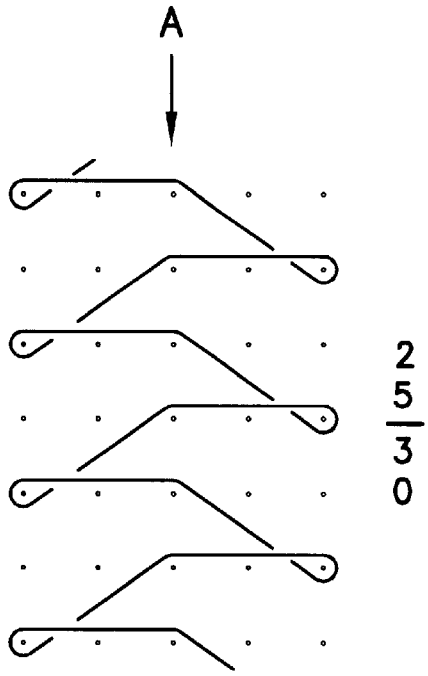

For the one yarn loops as showed in FIG. 1C it is possible to increase the height of the loops by having a bigger movement around the needles as shown in FIGS. 5*a* and 5*b*.

In FIG. 5*b* the pattern wheel is wt to knit at 2-5/3-0 for closed stitches.

Figure 6A:
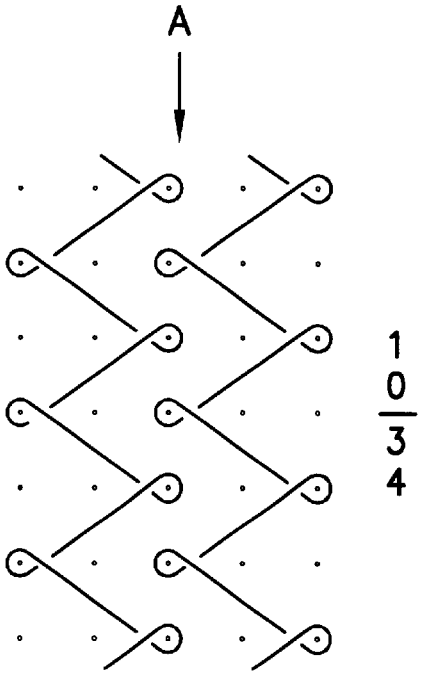
FIGS. 6*a* and 6*b* are point diagrams of the action of a guide bar of a knitted machine to the embodiment of FIG. 3*c;*
Figure 6B:
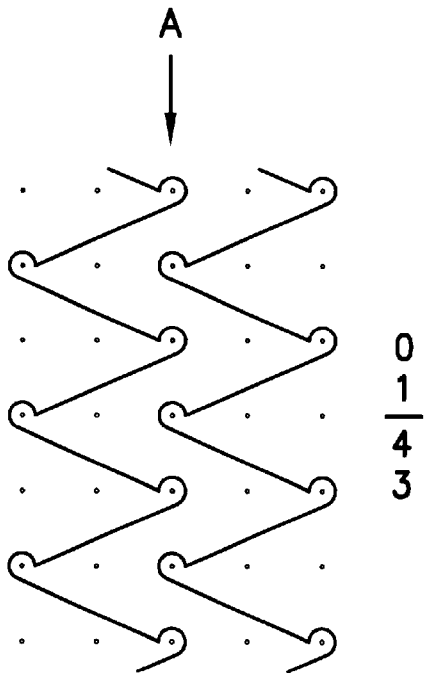
Figure 7A:
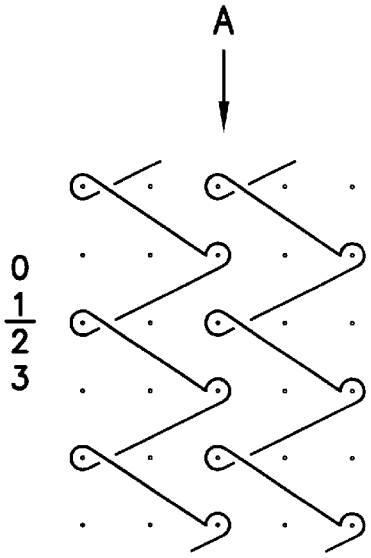
FIGS. 7*a* to 7*d* are point diagrams of the action of a guide bar of a knitted machine to produce a two yarn loop pile with alternating closed and opened stitches.
Figure 7B:
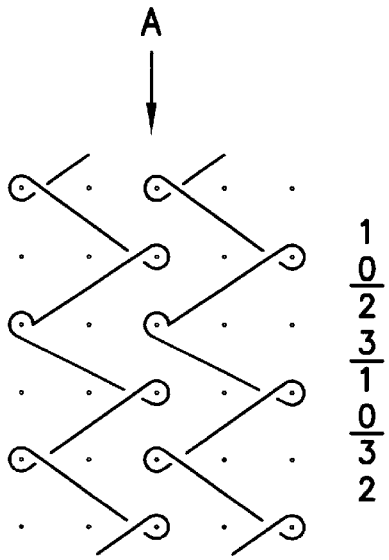
Figure 7C:
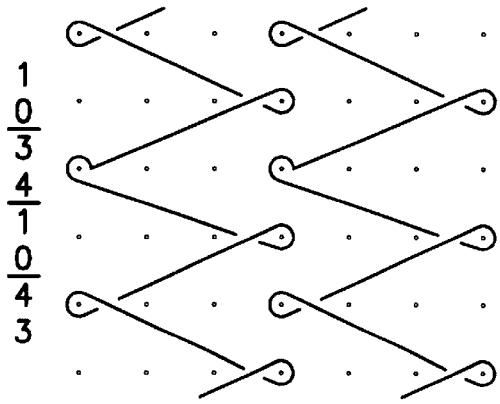
Figure 7D:
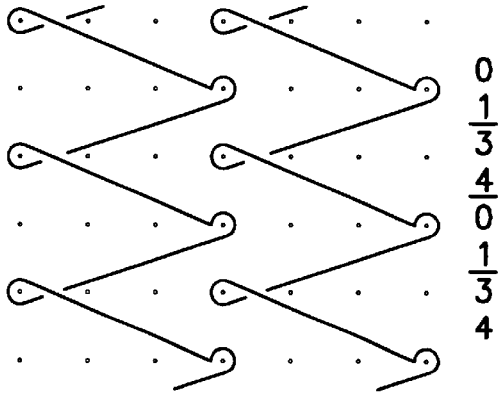

For the two yarns loops as shown in FIG. 3C it is possible in the same way to increase the height of the loops 3, that is by having a bigger movement between needles is shown in FIGS. 6*a* and 6*b*. In FIG. 6*a* the pattern wheel is set to knit at 1-0/3-4 for closed stitches. In FIG. 6*b* the pattern wheel is set to knit at 0-1/4-3 for opened stitches. For the tow yarn loops it is also possible to alternate closed and opened stitches at each row or at different rows as shown in FIGS. 7*a*, 7*b*, 7*c* and 7*d*.

A preferable support background for the embodiment of FIG. 3 is a weft insertion warp knitted fabric as shown in FIG. 3*a*. In this embodiment another guide bar is used to add chain stitches without loops.

In constructing the female component of the securing or attachment means, the guide bar preferably carries textured polyester, while the knitted support background yarn may be flat polyester. The weft insertion yarn may be textured polyester. The weft insertion yarn may be textured polyester. The present invention is not so limited however, and multifilament flat yarns and monofilament could also be used in any type of material.

To avoid de-knitting an additional yarn can be employed, using an additional guide bar, to simultaneously form other chain stitches with the same needle making the chain stitches with loops (A).

The additional bar should not work with the needles making the loop piles.

With the invention it is possible to vary the number of wales of chain stitches with loops. It is also possible to vary the size of the stitches without compromising the performance of the loops.

An advantage of the invention is that it permits increased formation speed or increased loop density in a given fabric area, thereby substantially improving the performance of the Tricot and Raschel knitting machines.

Figure 8:
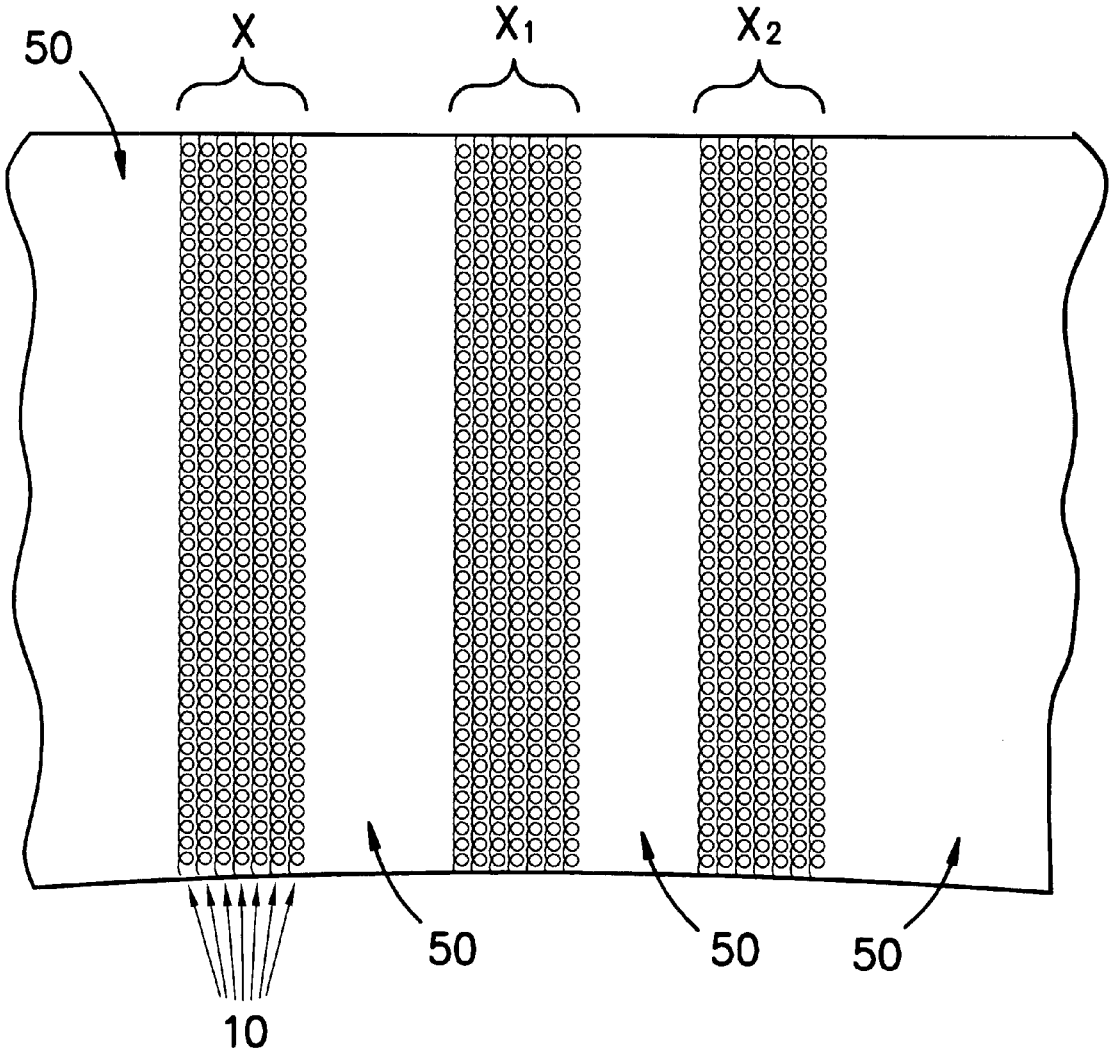
FIG. 8 show a weft insertion warp knitted fabric having vertical spaced apart bands, the bands alternatively being with and without chain stitches with loops.

In FIG. 8 a weft insertion warp knitted fabric 50 is provided with vertical bands x1, x2, x3 alternatively with and without chain stitches with loops. The support background may also be a non-woven of film material.

The support background 50 has vertical bands x made with certain number of chain stitches with loops 10. The vertical bands x, x1, x2 in the way if warp, could have the same at different widths by changing the number if chain stitches with loops per vertical band. Each vertical band of loops is made with consecutive chain stitches with loops obtained with yarns threaded on the same guide bar on a warp knitted machine, or on weft-insertion warp knitted machine, with or without non-woven or film stitched through with a non-woven or with a film as support background. The chain stitches with loops stitched through the support do not need additional yarn from another guide bar in warp and also do not need weft yarn—but it's possible to have both warp and weft or only the warp or only the weft in addition.

Preferably, a precise threading is provided to obtain the vertical band of loops.

By way of example, the following threading sequences are given:

with the pattern wheel set to knit as shown in FIGS. 2*a* and 2*b*, the threading:

1 in, 2 out may be used.

with the pattern wheel set to knit as shown in FIGS. 4*a* and 4*b*, the threading:

1 in, 4 out may be used.

with the pattern wheel set to knit as shown in FIGS. 6*a* and 6*b*, the threading:

2 in, 2 out may be used.

Further modifications and improvements may be incorporated without departing from the scope of the invention herein intended.

What is claimed is:

1. A knit female member of a hook and loop fastening or attachment structure comprising:

a loop wale having loop wale chain stitches with a corresponding loop associated with each loop wale chain stitch therein; and a background structure, wherein the background structure is a regular warp knitted fabric.

2. A knit female member of a hook and loop fastening or attachment structure comprising:

a loop wale having loop wale chain stitches with a corresponding loop associated with each loop wale chain stitch therein; and a background structure, wherein the background structure is a weft insertion warp knitted fabric.

3. A knit female member of a hook and loop fastening or attachment structure as claimed in claim 1, wherein the loop wale chain stitches include a front side and a technical side, and wherein the loops of the loop wale are disposed on the front side of the loop wale chan stitches.

4. A knit female member of a hook and loop fastening or attachment structure as claimed in claim 2, wherein the loop wale chain stitches include a front side and a technical side, and wherein the loops of the loop wale are disposed on the front side of the loop wale chan stitches.

5. A knit female member of a hook and loop fastening or attachment structure as claimed in claim 1, wherein the background material includes background chain stitches, and wherein each of the loop wale chain stitches are simultaneous with an associated one of the background chain stitches.

6. A knit female member of a hook and loop fastening or attachment structure as claimed in claim 2, wherein the background material includes background chain stitches, and wherein each of the loop wale chain stitches are simultaneous with an associated one of the background chain stitches.

* * * * *